US011131094B1

(12) United States Patent
Robinson

(10) Patent No.: US 11,131,094 B1
(45) Date of Patent: Sep. 28, 2021

(54) ROOF PAVER AND RAILING ASSEMBLY

(71) Applicant: Clayco, Inc., St. Louis, MO (US)

(72) Inventor: Eric Robinson, Chicago, IL (US)

(73) Assignee: CLAYCO, INC., St. Louis, MO (US)

( * ) Notice: Subject to any disclaimer, the term of this patent is extended or adjusted under 35 U.S.C. 154(b) by 0 days.

(21) Appl. No.: 16/798,557

(22) Filed: Feb. 24, 2020

Related U.S. Application Data

(60) Provisional application No. 62/814,916, filed on Mar. 7, 2019.

(51) Int. Cl.
*E04D 13/12* (2006.01)

(52) U.S. Cl.
CPC ..... *E04D 13/12* (2013.01)

(58) Field of Classification Search
CPC .. E04D 3/04; E04D 3/26; E04D 3/361; E04D 3/40; E04D 11/00; E04D 13/12; E04D 15/08; E04D 15/02183; E04B 1/003; E04B 5/02; E04B 7/026; E04B 7/20; E04B 7/205; E04C 2/044; E01C 5/06
See application file for complete search history.

(56) References Cited

U.S. PATENT DOCUMENTS 2,196,807 A * 4/1940 Eckert ..... E04D 11/00 52/464
2,210,941 A * 8/1940 Leemhuis ..... E04B 7/20 52/459
3,279,134 A 10/1966 Donovan
4,445,802 A * 5/1984 Loov ..... E01C 15/00 404/40
5,363,614 A * 11/1994 Faulkner ..... B26D 3/008 52/262
5,713,171 A 2/1998 Andres
7,918,059 B2 4/2011 Repasky
8,011,148 B2 9/2011 Bertke et al.
8,695,288 B2 4/2014 Kugler et al.
9,441,378 B1 * 9/2016 Conklin ..... E04D 11/007
9,663,954 B1 5/2017 Fernandez
9,834,893 B2 12/2017 Lynch
2004/0250495 A1 * 12/2004 Manthei ..... E01C 5/06 52/589.1
2011/0296791 A1 * 12/2011 Finn ..... E01C 15/00 52/745.21
2012/0090256 A1 4/2012 Andrews
2016/0122996 A1 * 5/2016 Timberlake ..... E04C 5/0604 52/236.3
2020/0354946 A1 * 11/2020 Wilson ..... E04B 1/34823

FOREIGN PATENT DOCUMENTS

DE 3032800 A1 * 4/1982 ..... E04D 11/00

* cited by examiner

*Primary Examiner* — Christine T Cajilig
(74) *Attorney, Agent, or Firm* — Thompson Coburn LLP

(57) ABSTRACT

A paver having a length and a width. The length of the paver is about 4 feet, and the width of the paver is about 2 feet. The paver weighs about 400 pounds, and has a railing post mounted adjacent a width edge. The paver may be a part of a system of railing and non-railing pavers.

9 Claims, 7 Drawing Sheets

ROOF PAVER AND RAILING ASSEMBLY

CROSS-REFERENCE TO RELATED APPLICATIONS

The present application claims the benefit of U.S. Provisional Application Ser. No. 62/814,916, filed Mar. 7, 2019, the disclosure of which is incorporated herein by reference in its entirety.

BACKGROUND AND SUMMARY

The present disclosure is directed to a roof paver and a railing assembly. In particular, the disclosure is directed to roof paver with an integrated railing assembly. More in particular, the roof paver is a precast concrete or aggregate slab that may be suspended above a roof surface with pedestals. A railing may be attached to the slab and supported by the slab. The weight of the paver may be sufficient to prevent instability of the paver when a point load is applied to the railing mounted to the paver.

DETAILED DESCRIPTION

Figure 1:
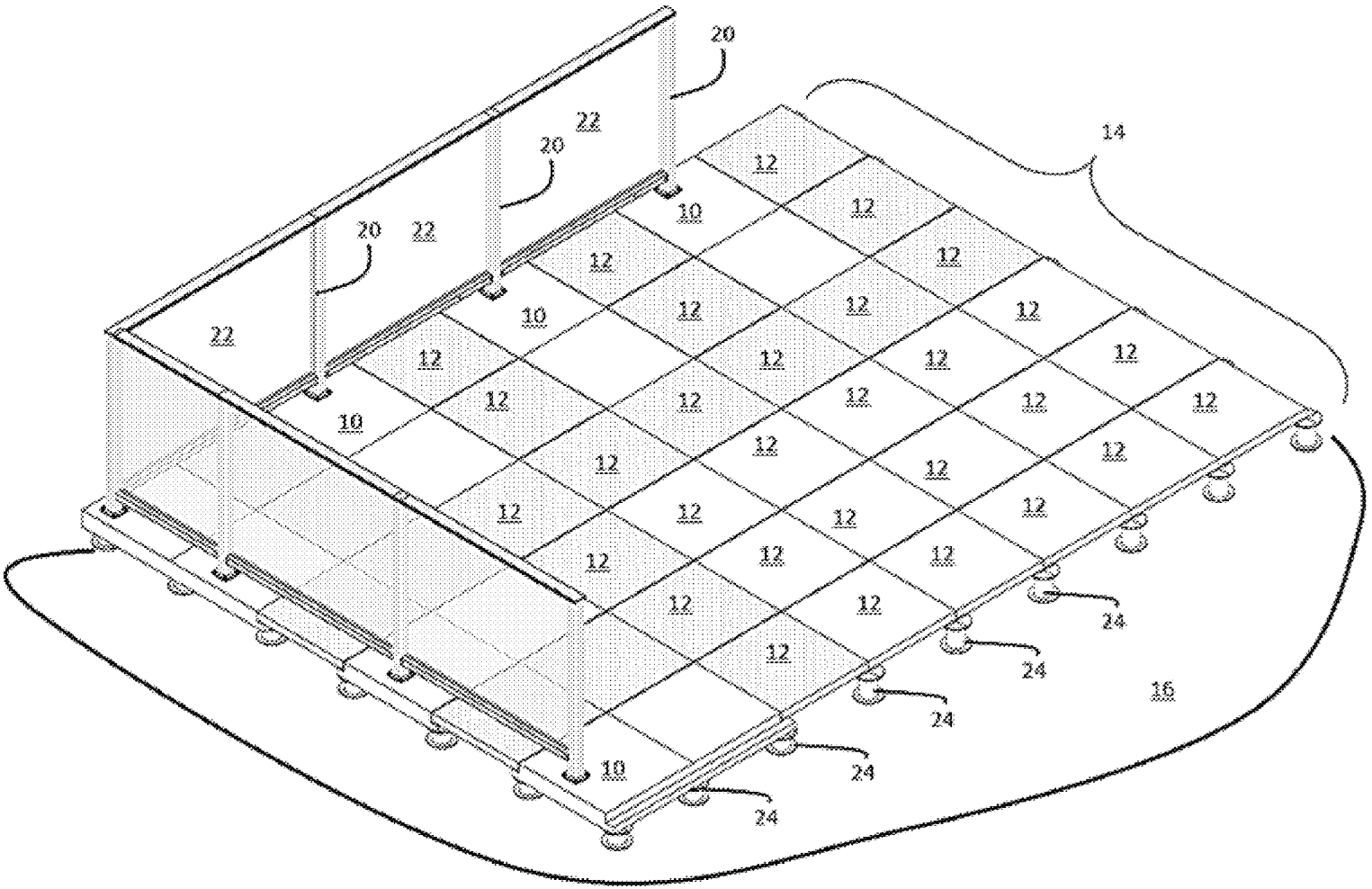
FIG. 1 is a perspective view of a paver system for a roof, including railing pavers and non-railing pavers assembled into the system for supporting a railing.
Figure 2:
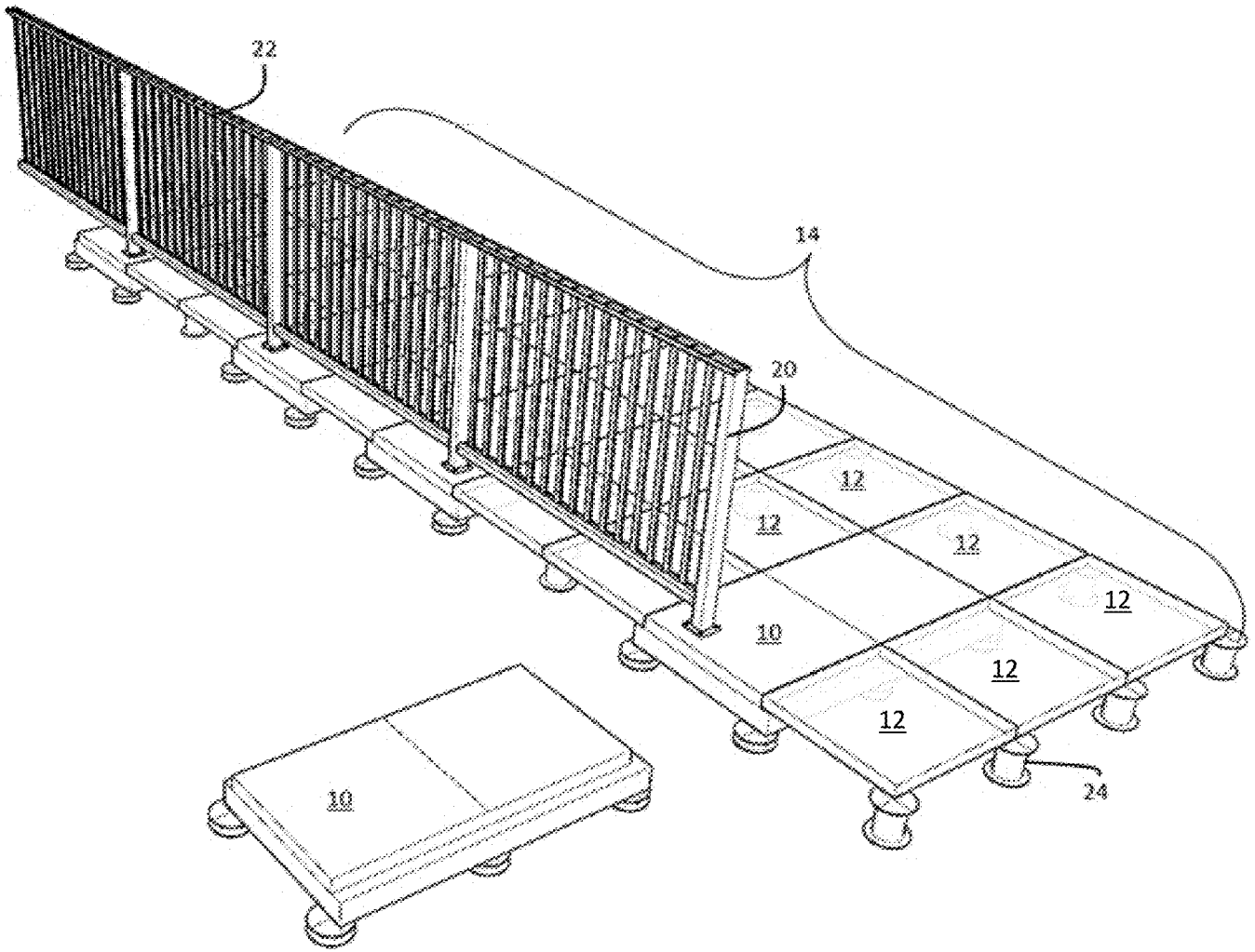
FIG. 2 is an alternate perspective view of a paver system for a roof, including railing pavers and non-railing pavers assembled into the system for supporting a railing. A railing paver is also shown separately from the system to provide additional detail.
Figure 3:
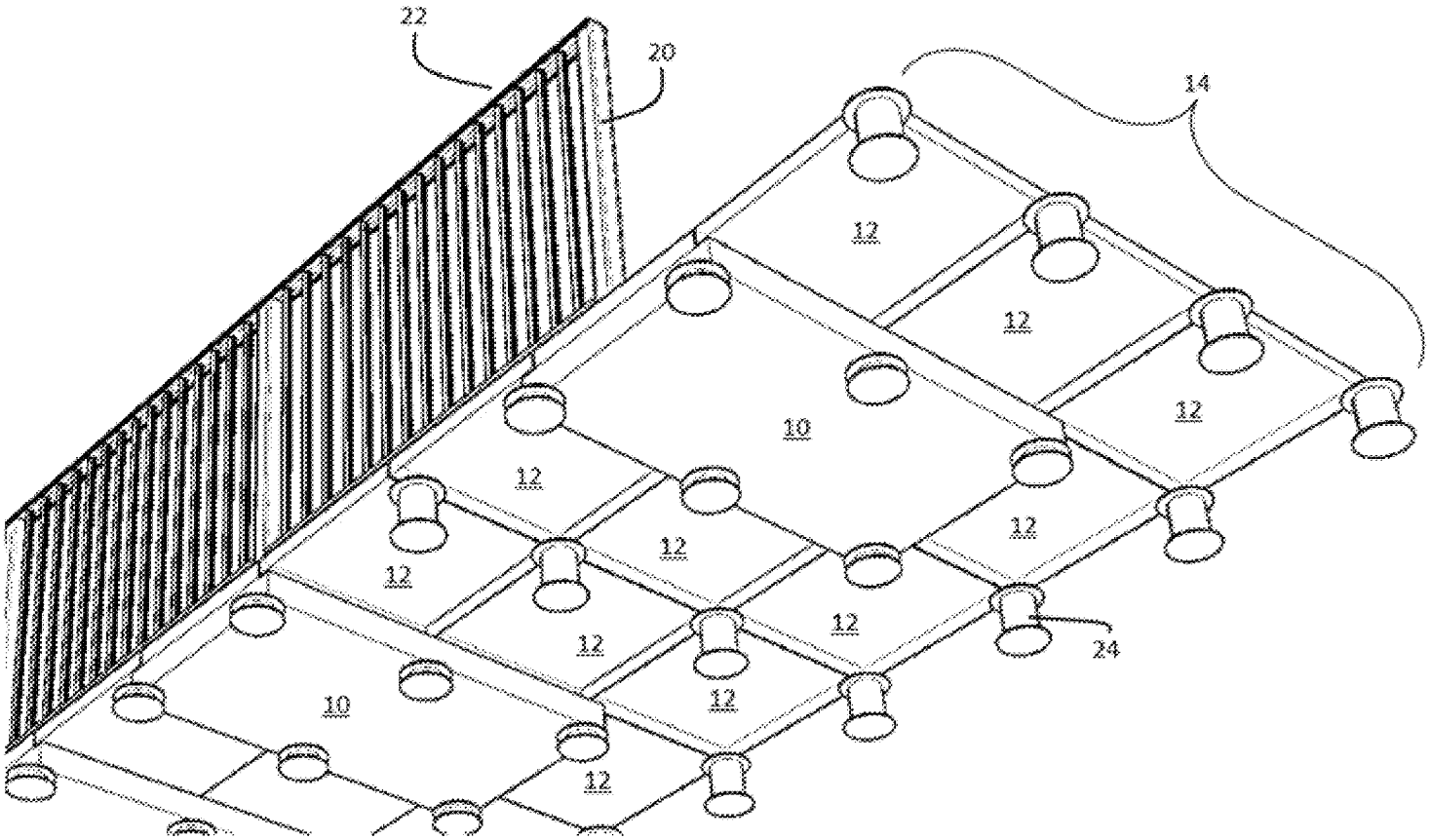
FIG. 3 is an alternate perspective view of a paver system for a roof, including railing pavers and non-railing pavers assembled into the system for supporting a railing with additional detail of pedestals associated with the system.
Figure 4:
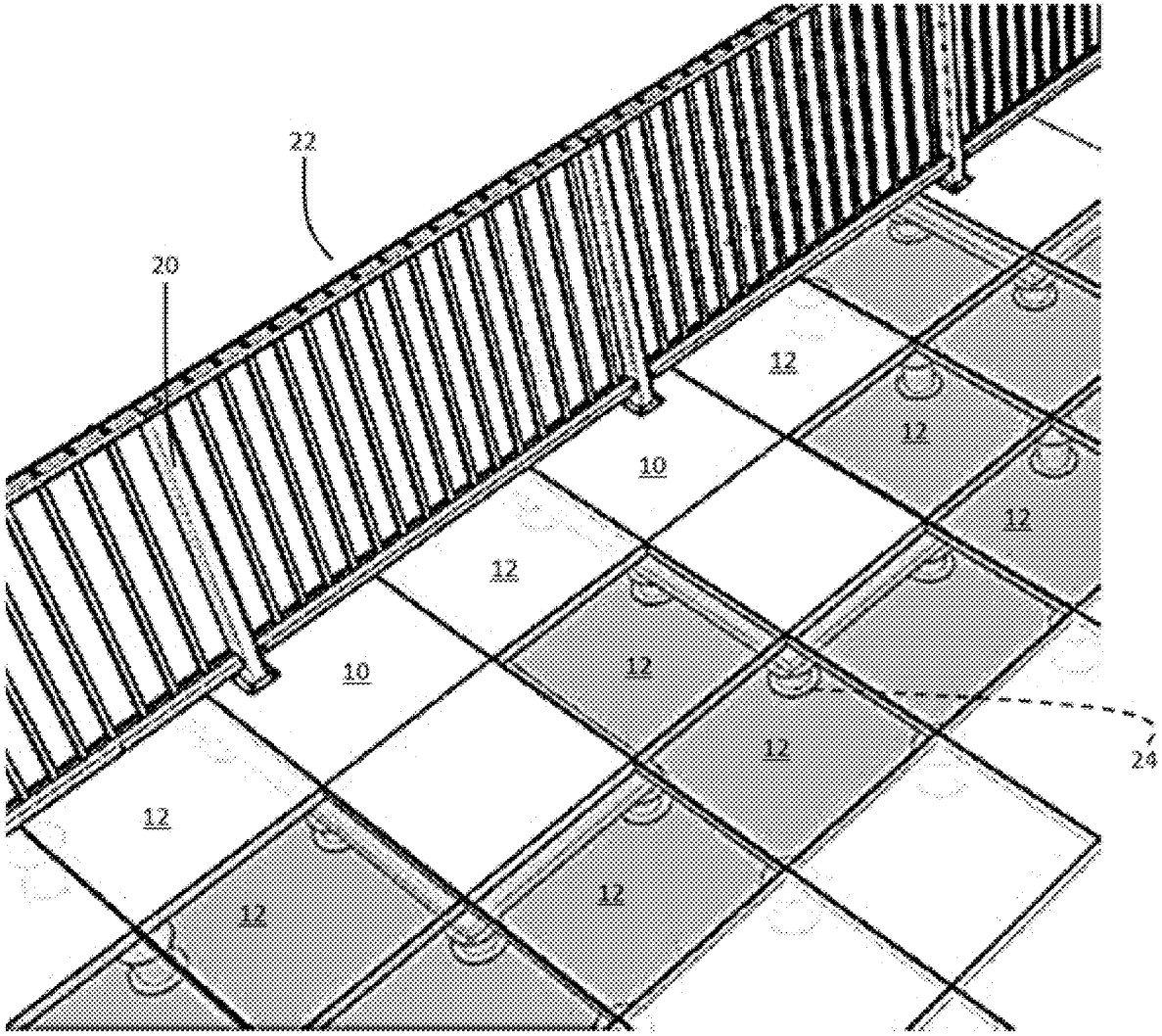
FIG. 4 is an alternate perspective view of a paver system for a roof, including railing pavers and non-railing pavers assembled into the system for supporting a railing with the pedestals associated with the system shown in phantom.
Figure 5:
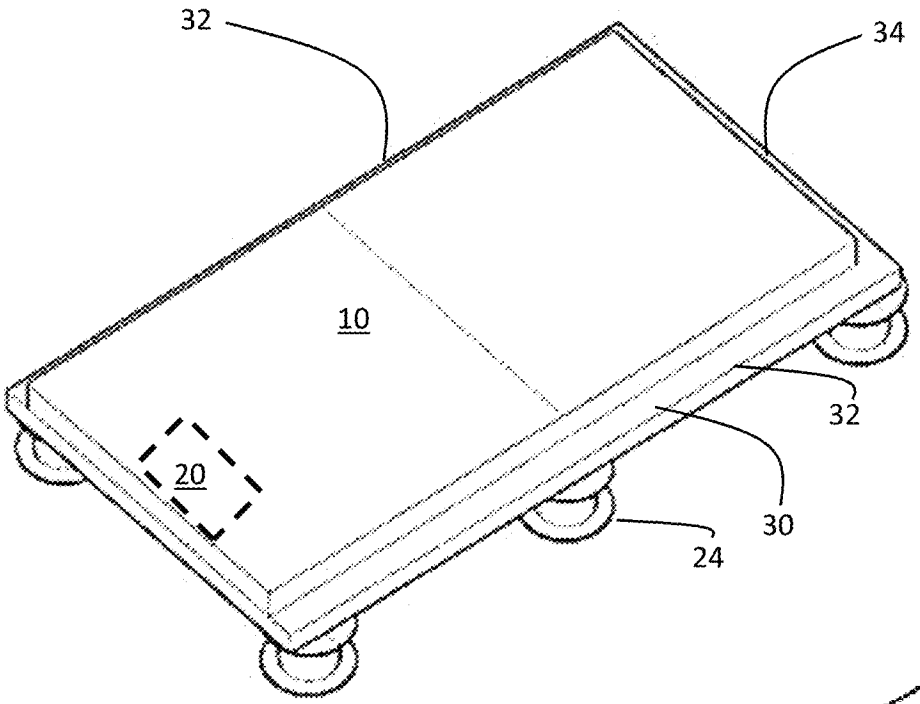
FIG. 5 is a perspective view of an exemplary railing paver.
Figure 6:
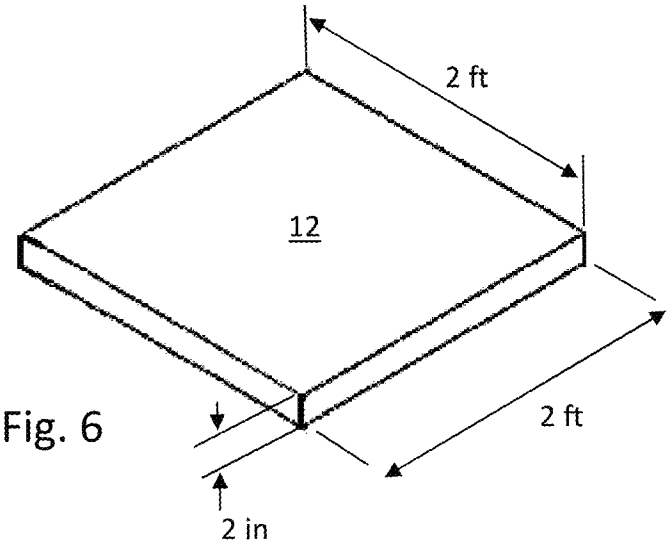
FIG. 6 is a perspective view of an exemplary nominal 2 foot by 2 foot non-railing paver.
Figure 7:
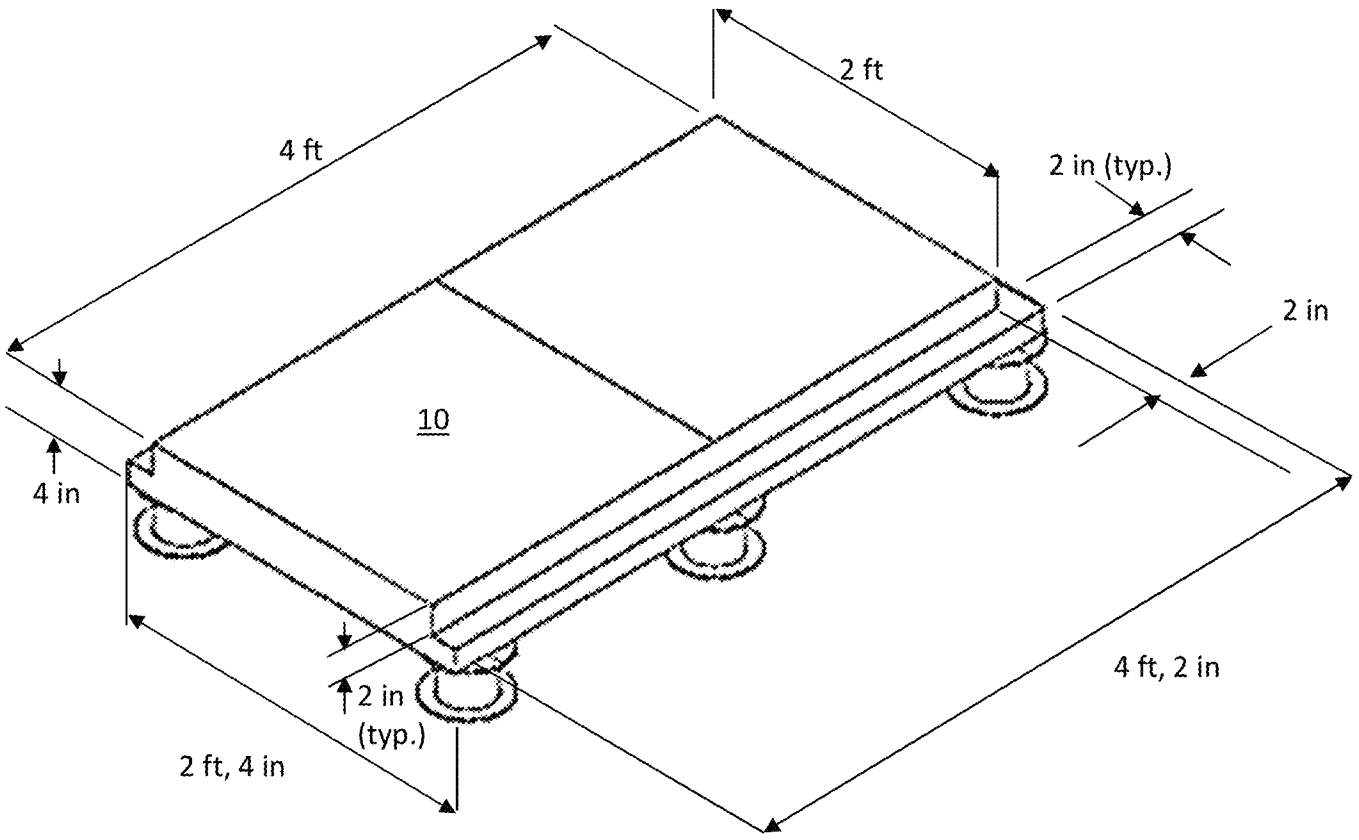
FIG. 7 is a perspective view of an exemplary nominal 2 foot by 4 foot railing paver.
Figure 8:
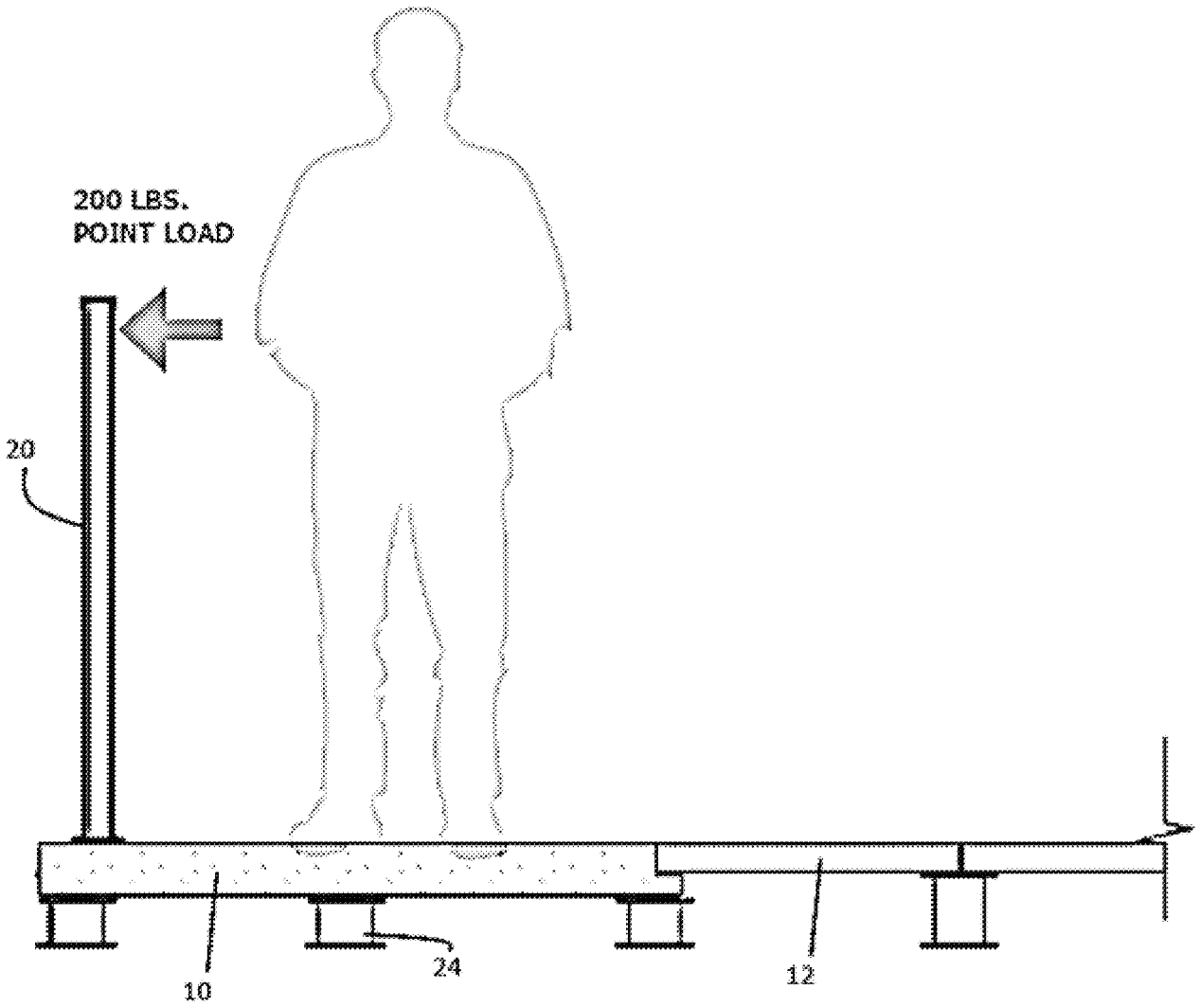
FIG. 8 is a side view of a railing paver and non-railing paver with a post of the railing.

Pavers 10,12 may be assembled together in a system 14 used on a roof 16 of a building. The pavers 10,12 may be made from precast concrete or another similar thermally cured, bound aggregate material. The pavers may either be railing pavers 10 or non-railing pavers 12. The railing pavers 10 may have a railing post 20 mounted thereto and may be assembled on the roof with other similar railing and non-railing pavers. The railing paver 10 may be formed with holes that receive mechanical fasteners to secure the railing post 20 to the railing paver. The holes may be pre-formed during casting or formed on site as needed during installation of the system. Threaded rod may inserted and adhered in the holes. The holes may be through holes or blind holes. Additionally, the railing paver 10 may be provided with a boss, a protuberance, or a recess for locating the railing post 20 on the railing paver. The railing paver 10 may be sufficiently thick and dense to enable the railing post 20 to be secured to the railing paver with sufficient structural integrity to prevent cracking of the paver when the railing post is loaded or subjected to a moment. A railing 22 may extend between the railing posts 20. The railing and non-railing pavers 10,12 may be supported by a plurality of pedestals 24 that are placed on the roof surface 16 so the paver is positioned above and parallel to the roof. The pedestals may be positioned at corners and along the length edge of the pavers. The pedestals 24 may be placed on the roof with or without penetrating the roof surface 16 so as to limit water intrusion through the roof surface.

The railing paver 10 may be similar in appearance to a non-railing paver 12 in the system of pavers 14. The railing paver may be made from the same materials as the non-railing paver so it appears similar to the rest of the pavers in the system, although the color may be different in accordance with a desired aesthetic appearance. In one example, the railing paver has a length longer than a width. The railing post may be mounted to a width end. The railing paver 10 may be thicker and longer than the non-railing paver 12 and thus heavier than a non-railing paver. In one example, the railing paver 10 may be twice as long as a non-railing paver and may have a false joint or partial saw cut across the width at the length center-line to simulate a non-railing paver. In one example, the railing paver 10 is nominally 4 feet long and 2 feet wide with a false joint across the width at the length centerline so that the railing paver resembles two 2 foot long by 2 foot wide non-railing pavers 12. The railing paver 10 may be 4 inches thick and weigh at least about 400 pounds. The non-railing pavers 12 may be nominally 2 foot long by 2 foot wide by 2 inches thick and weigh at least about 100 pounds. The railing paver 10 may have the railing post 20 mounted to the railing paver adjacent to one width edge. The railing post 20 may extend upwards from the paver at least about 30 inches and in some case at least about 42 inches.

The railing paver 10 may have a shelf or recessed edge 30 around its top perimeter. The recess of shelf 30 may be provided on one or both of the longitudinal edges 32 of the railing paver. A recess or shelf may also extend along one of the width edges so the shelf extends around three sides of the railing paver including the width edge 34 opposite the width edge with the railing post 20. The shelf may be a 2 inch recessed edge so the overall dimensions of the paver taking into account the shelf are 4 feet-2 inches long by 2 feet-4 inches wide, thus allowing the exposed top edges of the railing paver to be 4 feet long by 2 feet wide (and with the false joint, the paver resembles two 2 foot long by 2 foot wide pavers). Non-railing pavers 12 may be placed adjacent to the railing paver on the railing paver shelf to assist in maintaining the railing paver in position on the respective pedestals. The adjoining non-railing pavers may provide ballast to counteract any moment applied to the railing post of the railing paver and the railing extending between railing posts of the railing pavers in the system. The non-railing pavers may interlock with the shelf of the railing pavers or may simply rest on the shelf of the railing pavers. The recess or shelf on the railing paver may have a depth that accommodates the thickness of the non-railing paver so the top surfaces of the railing paver and non-railing paver are at substantially the same height and flush with one another. For instance, for a non-railing paver having a thickness of two inches, the depth of the recess on the railing paver may be two inches.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A method comprising:

providing a railing paver wherein the railing paver has a length and a width, the railing paver length is about 4 feet, the railing paver width is about 2 feet, the railing paver weighs at least about 400 pounds;

providing a non-railing paver, wherein the non-railing paver has a length and a width, the non-railing paver length is about 2 feet, the a non-railing paver width is about 2 feet, the non-railing paver weighs at least about 100 pounds;

attaching a railing post to the railing paver adjacent to a width edge of the railing paver; and placing the non-railing paver adjacent to the railing paver on at least one of a first length edge of the railing paver, a second length edge of the railing paver opposite the first length edge, and a width edge of the railing paver opposite the width edge with the railing post.

2. The method of claim 1 wherein the step of providing the railing paver includes providing the railing paver with a recess on at least one the railing paver length edges.

3. The method of claim 1 wherein the step of placing the non-railing paver adjacent to the railing paver includes placing the non-railing paver on the longitudinal recess.

4. The method of claim 3 wherein the step of providing the railing paver includes providing the railing paver with a width recess, the width recess extending on a width edge opposite the railing post.

5. The method of claim 4 wherein the step of placing the non-railing paver adjacent to the railing paver includes placing the non-railing paver on the width recess.

6. The method of claim 1 wherein the step of attaching the railing post to the railing paver adjacent to the width edge of the railing paver includes providing the railing post with a length of at least about 30 inches.

7. The method of claim 1 further comprising:

providing a second railing paver having a length and a width, the second railing paver length being about 4 feet, the second railing paver width being about 2 feet, the second railing paver weighing at least about 400 pounds;

arranging the second railing paver adjacent to the non-railing paver;

attaching a railing post to the second railing paver adjacent to a width edge of the second railing paver; and extending a railing between the railing post of the railing paver and the railing post of the second railing paver.

8. The method of claim 7 wherein the step of placing the non-railing paver adjacent to the railing paver includes providing seven non-railing pavers and placing two non-railing pavers adjacent to the first length edge of the railing paver, placing two non-railing pavers adjacent to the second length edge of the railing paver and adjacent to the first length edge of the second railing paver, placing one non-railing paver adjacent to the width edge of the railing paver opposite the width edge with the railing post, placing one non-railing paver adjacent to the width edge of the second railing paver opposite the width edge with the railing post of the second railing paver, and placing two non-railing pavers adjacent to the second length edge of the second railing paver.

9. The method of claim 1 wherein the step of placing the non-railing paver adjacent to the railing paver includes providing five non-railing pavers and placing two non-railing pavers adjacent to the first length edge of the railing paver, placing two non-railing pavers adjacent to the second length edge of the railing paver, and placing one non-railing paver adjacent to the width edge opposite the width edge with the railing post.

* * * * *